US005126512A

United States Patent [19]

Derry

[11] Patent Number: 5,126,512

[45] Date of Patent: Jun. 30, 1992

[54] ELECTRICAL CABLE WITH CURVED PORTION

[75] Inventor: David M. Derry, Baltimore, Md.

[73] Assignee: GSI Corporaiton, Timonium, Md.

[21] Appl. No.: 603,450

[22] Filed: Oct. 26, 1990

[51] Int. Cl.[5] ..... H01B 7/00

[52] U.S. Cl. ..... 174/117 M; 139/425 R; 174/72 TR

[58] Field of Search ..... 174/117 M, 72 TR; 139/425 R

[56] References Cited

U.S. PATENT DOCUMENTS 3,835,894 9/1974 Speich ..... 139/55.1
3,909,508 9/1975 Ross ..... 174/117 M
4,158,104 6/1979 Ross ..... 174/117 M
4,808,771 2/1989 Orr, Jr. ..... 174/72 R

*Primary Examiner*—Morris H. Nimmo
*Attorney, Agent, or Firm*—Bacon & Thomas

[57] ABSTRACT

A flat woven cable having a generally flat construction and a curved portion therein and method for making the same are disclosed. The cable includes a plurality of conductors and a continuous fill strand interwoven in a twill weave to link the conductors together. The cable also includes outer and inner portions wherein the fill strand is interwoven with a lesser number of conductors in the inner area than in the outer area. The cable is free of warp binder strands and fill strand is heat shrunk following formation of the curved portion.

12 Claims, 4 Drawing Sheets

ELECTRICAL CABLE WITH CURVED PORTION

BACKGROUND OF THE INVENTION

The present invention relates to woven electrical and/or electronic cables and more particularly to woven electrical cables having a generally flat construction and a curved portion therein. The invention also relates to a method for making such cables.

Woven flat cables of the type having a plurality of conductors arranged in a side-by-side manner are used for a number of applications. For example, such cables are frequently used in avionic, computer, communication and other devices where space is limited. For such applications, it is frequently necessary to change cable direction, i.e., to redirect the cable from one area in the device to another area in a manner which requires bending and/or curving of the cable. In such cases, it may also be important to change cable direction with out bunching or otherwise distorting the position of the individual conductors within the cable.

On approach to provide a curved woven flat cable having a plurality of conductors arranged generally side-by-side is disclosed in the U.S. Pat. No. 4,158,104, of Edgar A. Ross. As disclosed therein, a woven cable portion has a plurality of warp strands and a continuous fill strand mutually interwoven with the conductors to bind the conductors together. The conductors are woven together with a plane weave pattern on a conventional loom. A curved cable portion includes at least one void area wherein the conductors are not interwoven with the warp strands and the fill strand leaving the conductors relatively unbound in the void area. The void area is preferably formed by floating the weave of warp and fill strands outside of the conductors and cable in this area. Under this approach, the conductors are curved about the void area to form the desired curved configuration. A conforming coating is then applied to maintain the curved portion.

The present invention contemplates an improved woven electrical cable having a curved portion therein which does not require a conforming coating to maintain the curved portion. The invention also contemplates an improved woven electrical cable which eliminates the detrimental bulking associated with the prior art curved portions. For example, in the woven electrical cables according to the present invention, there is no bulking of the cable formed by the compression of the weave material in the "void" area. Such cables are also free of the relatively stiff conforming coatings and are therefore more flexible to conform to relatively limited space requirements. In addition, the woven cables according to the present invention have a tight weave provides structural integrity to the cable.

SUMMARY OF THE INVENTION

A woven electrical cable in accordance with the present invention has a generally flat construction and a curved portion therein. The cable comprises a plurality of conductors which are arranged in a side-by-side or ribbon like manner and a continuous fill strand. This continuous fill strand is interwoven with the conductors in a twill weave pattern to bind the conductors together. A curved portion of the cable includes outer and inner areas and is constructed and arranged so that the fill strand is interwoven with a lesser number of conductors in a predetermined portion of the inner area than in an adjacent outer area. This construction leaves at least one and preferably a number of void areas in the curved portion of the cable. And, the void areas are free of any binder, i.e., fill strand or warp strands.

In a preferred embodiment of the invention, the curved portion of the cable also includes an intermediate area wherein the fill strand is interwoven with a lesser number of conductors than in the outer ware but with a greater number of conductors than in the inner area. In this embodiment, the cable is free of warp binder strands and the fill strand is heat shrunk after the cable is woven.

The present invention also contemplates a method for forming a curved portion in a flat woven cable having a plurality of side-by-side conductors without causing distortion in the cable. In accordance with this method, a plurality of longitudinally elongated conductors is arranged on a suitable loom such as a needle loom and interwoven with a single continuous Dacron polyester or other heat shrinkable fill strand. The conductors are interwoven with a twill weave construction and preferably with a herringbone pattern. For example, it has been found that a herringbone pattern with alternating and intersecting segments defining a void or non woven area therebetween is effective in forming a curved portion in the cable. After weaving and forming, the fill strand is heated and heat shrunk to thereby form a finished cable. The resulting cable has a flat construction and is curved about an axis which is perpendicular to the plane of the flat cable.

BRIEF DESCRIPTION OF THE DRAWINGS

The invention will now be described in connection with the accompanying drawings wherein like reference numerals have been used to designate like parts.

DESCRIPTION OF A PREFERRED EMBODIMENT OF THE INVENTION

Figure 1:
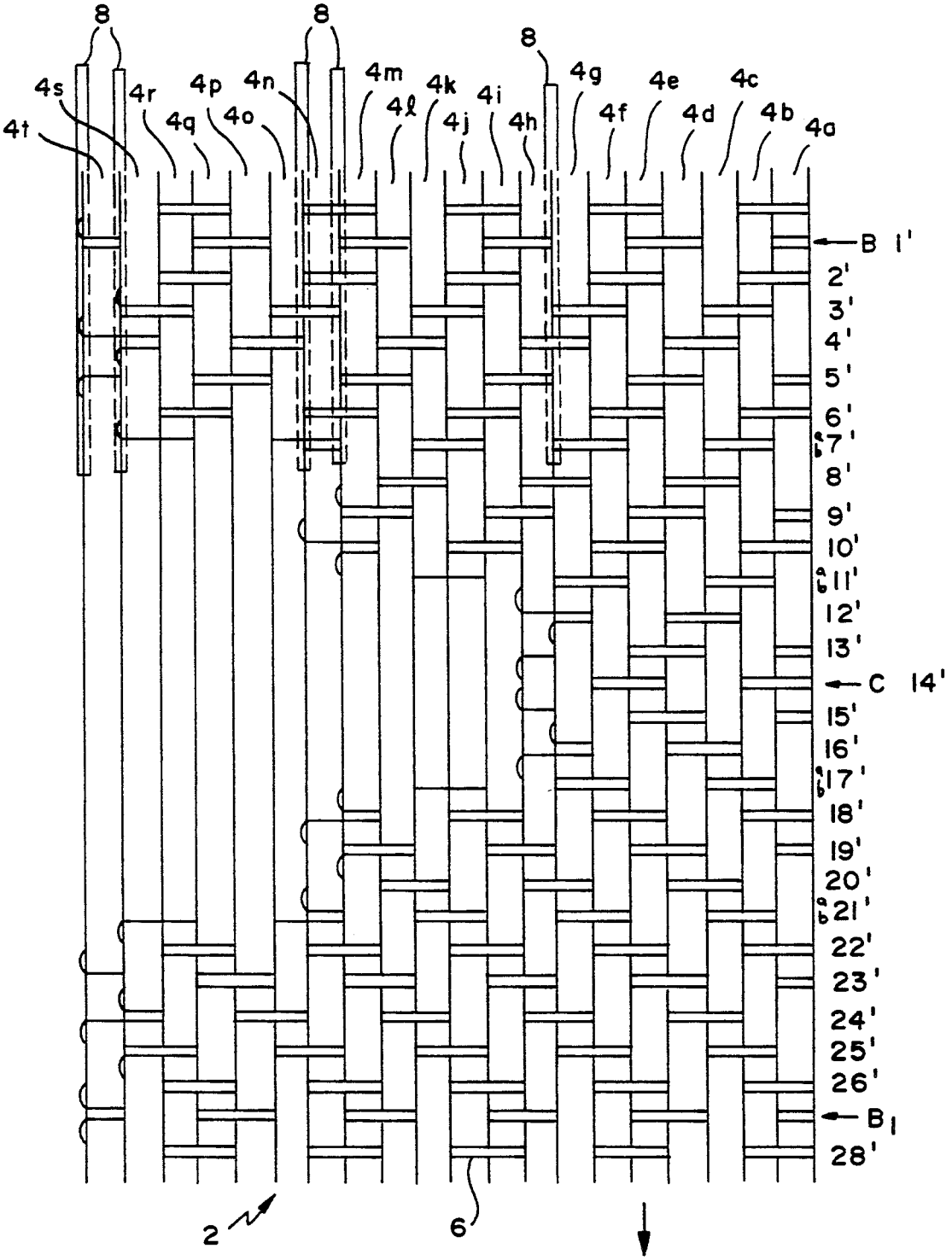
FIG. 1 is a top plan view which illustrates a weave pattern of a flat woven cable constructed in accordance with the present invention on a needle loom prior to being curved, and illustrating a void or non woven area formed between the alternating and intersecting segments of a herringbone weave.
Figure 1A:
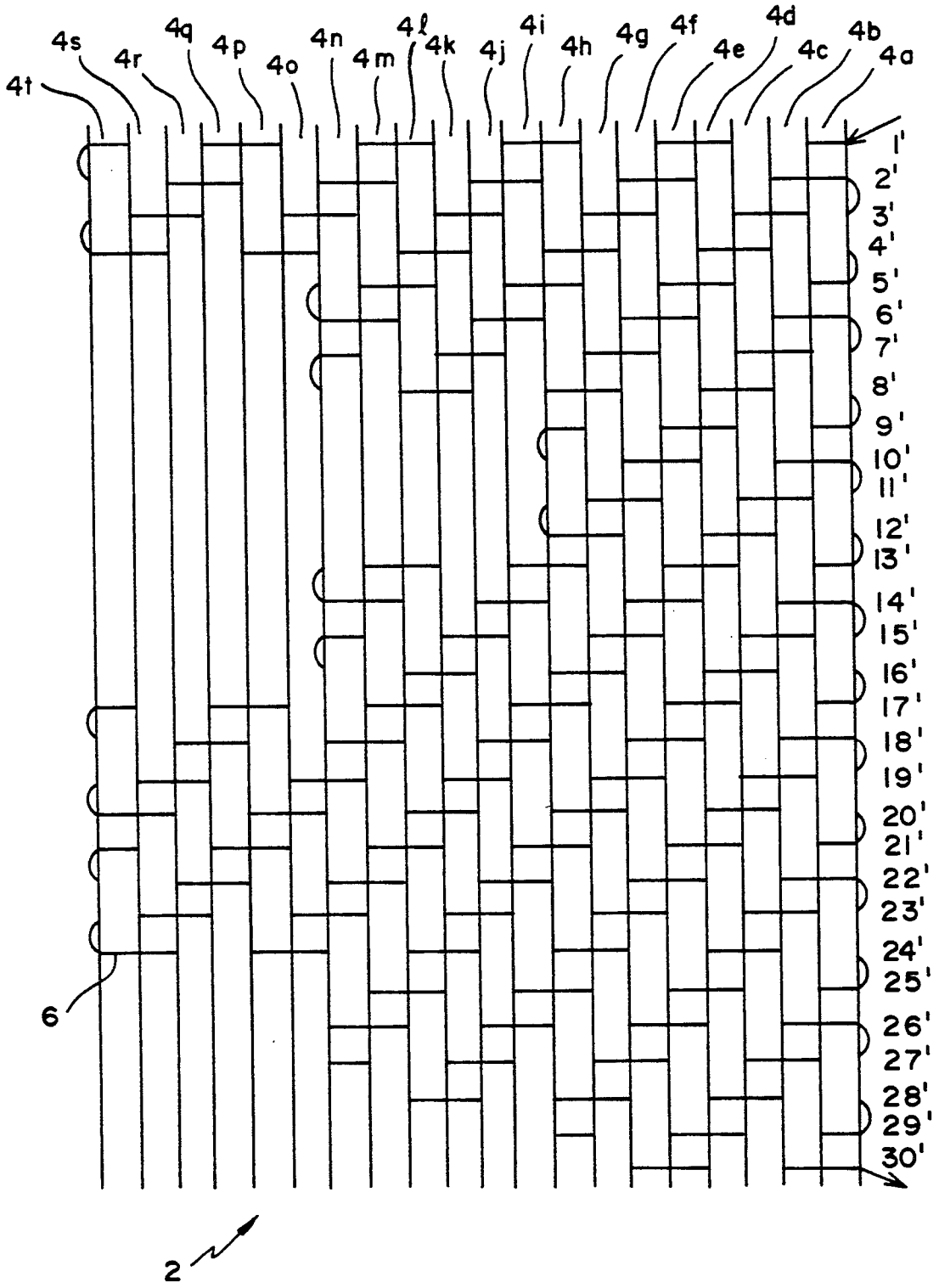
FIG. 1*a* is a top plan view which illustrates a straight twill weave pattern of a flat woven cable constructed in accordance with the present invention on a shuttle loom prior to being curved, and illustrating a void or non woven area.
Figure 2:
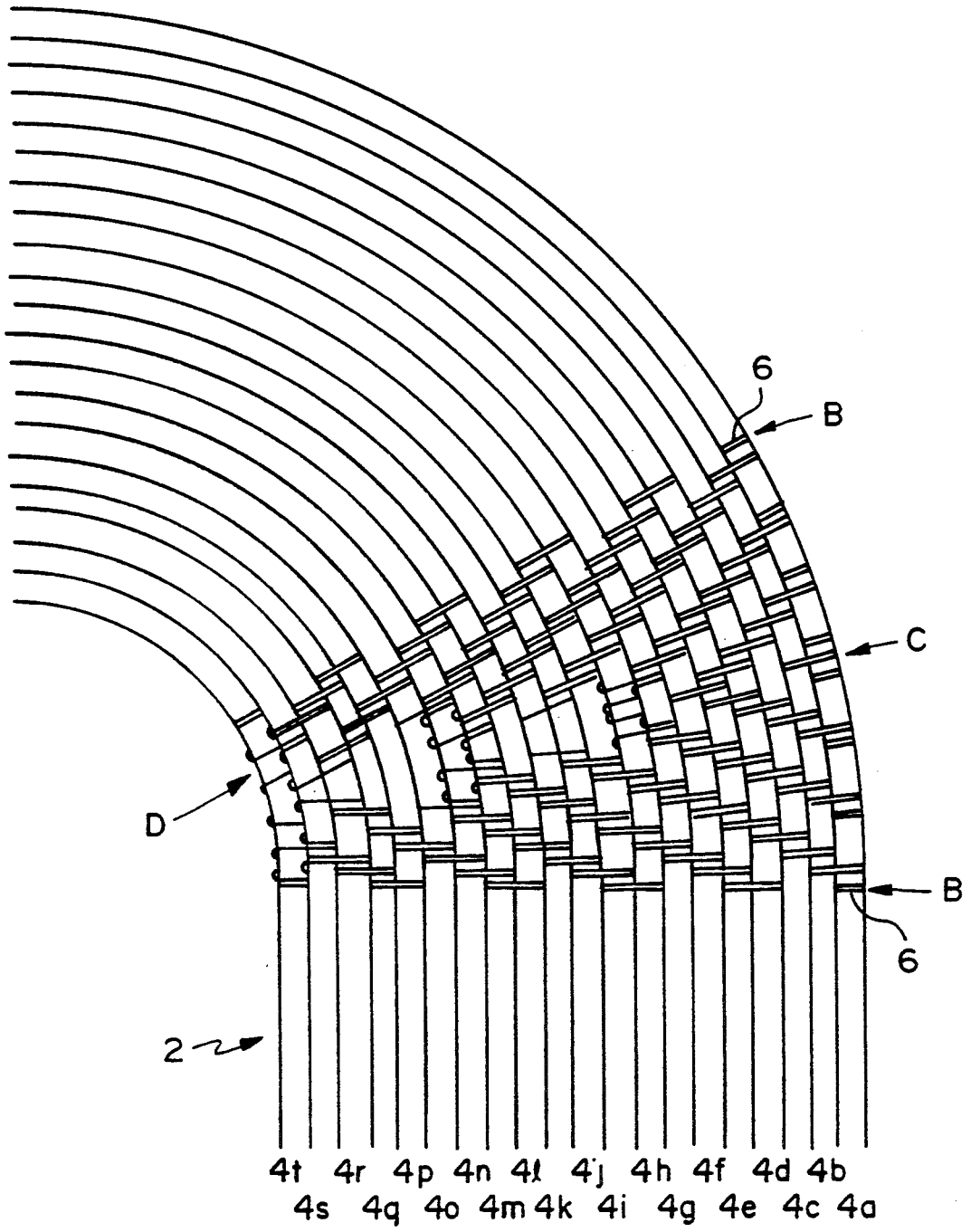
FIG. 2 is a top plan view of a flat woven cable constructed in accordance with the present invention as illustrated in FIG. 1, but illustrating the weave pattern of a curved portion thereof.

A flat woven cable 2 having a ribbon like construction is shown in FIGS. 1, 1A and 2. As illustrated therein, the cable 2 includes a plurality of longitudinally extending parallel insulated conductor 4*a*–4*t* which are arranged in a side-by-side relationship. The conductors 4 are woven together with a continuous fill strand 6 on an appropriate loom such as a needle loom (FIGS. 1 and 2). The fill strand 6 passes around the conductors and is interwoven with the conductors 4 into a twill weave in a manner which will be well understood by those who are skilled in the art of weaving electrical cables.

On a shuttle loom the fill strand 6 is wound on a bobbin which is passed through the cable by a shuttle. With each pass of the shuttle, the pattern advances one pick before the shuttle makes a return pass. As illustrated a pick is a single fill strand running across the cable 2 in the x direction while the conductors 4 are illustrated as running in the y direction. Thus, the number of picks is shown numerically on the right side of FIGS. 1 and 1A.

On a needle loom, a needle will carry a loop of the fill strand 6 through the cable 2 from left to right. The loop is then caught by a hook on the right side and pulled through the previous pick in a crochet method. The needle then returns to the home (left) position before the pattern advances. In this case, a pick is a loop of the fill strand 6 passing through the cable 2. Therefore, the fill strand 6 is shown by the double lines in FIG. 1.

Figure 3:
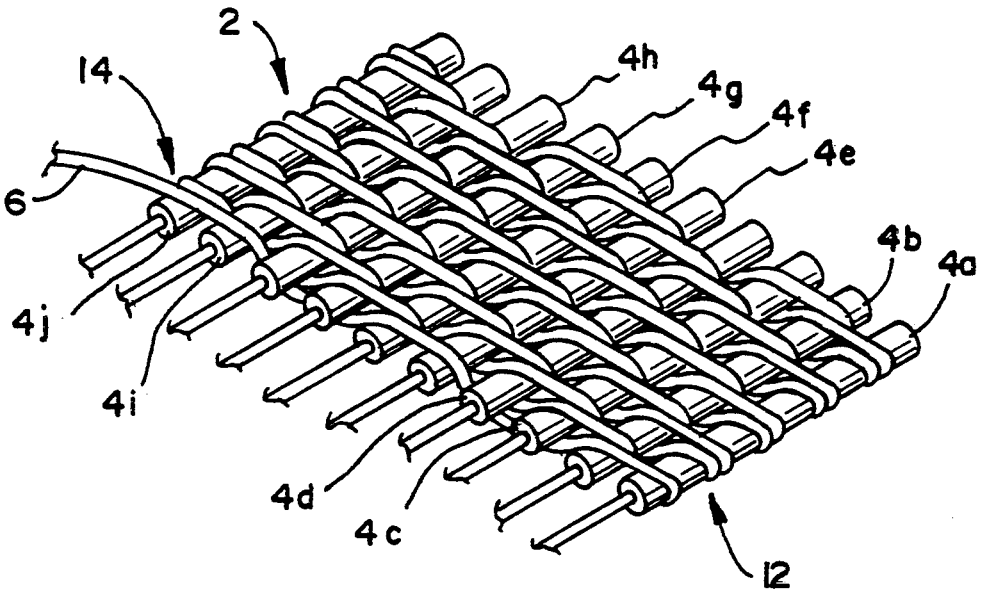
FIG. 3 is a perspective view which illustrates a segment of a woven electrical cable which is bound together by a twill weave; and, FIG. 4 is a top plan view of a flat woven cable constructed in accordance with the present invention as it appears to an observer after the fill strand is heat shrunk.
Figure 4:
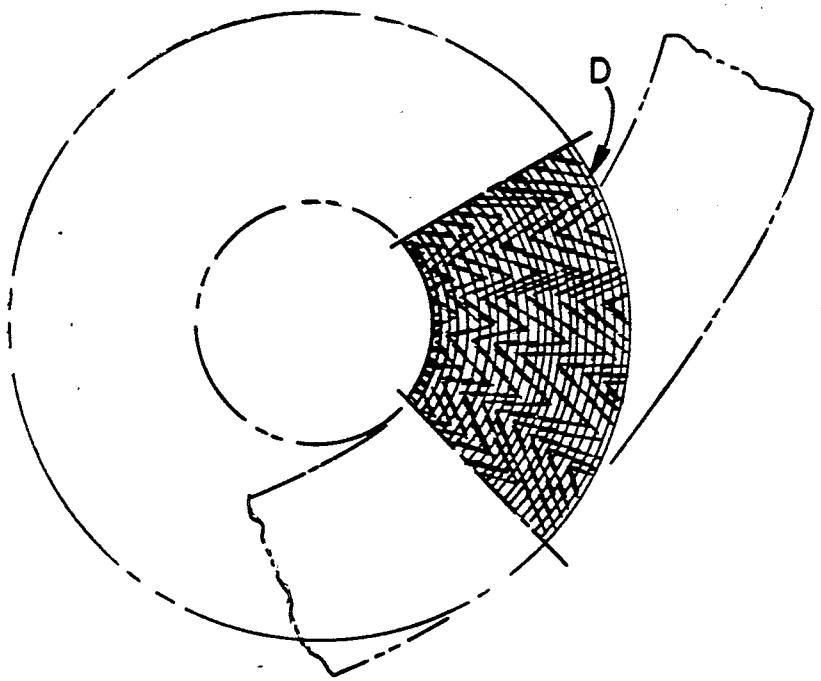

A segment of the cable 2 shown more clearly in FIG. 3 illustrates a twill weave as woven on a conventional shuttle loom. As illustrated, the woven cable 2 has a plurality of conductors 4*a*–4*j* with a single weft thread or fill strand 6 woven between and binding the conductors 4*a*–4*j* together in a staggered wave or twill pattern. As illustrated, the fill strand 6 passes over at least two adjacent conductors in each of a plurality of passes through the cable 2 to thereby provide a two-up two-down pattern. For example, in a first section 12 the fill strand 6 passes over the conductors 4*a* and 4*b*, under the next two conductors 4*c* and 4*d*, over the next two conductors 4*e* and 4*f* and so forth across the width of the cable 2. In a second section 14 of the cable 2, the fill strand 6 also passes over and under the conductors in a two-up two-down pattern but with the pattern displaced laterally by one conductor. Thus the fill strand 6 passes over conductor 4*a*, under 4*b* and 4*c*, over conductor 4*d* and 4*e* and so forth across the cable 2. The use of a twill weave in a straight or non curved woven electric cable is disclosed in U.S. Pat. No. 3,909,508 of Edgar A. Ross which is incorporated herein in its entirety by reference.

Staggering the weave pattern by for example a single wire binds the conductors 4*a* ∝ 4*t* together in a parallel configuration and prevents slipping in either the longitudinal or lateral direction without any warp threads. The elimination of warp threads is considered highly desirable since the use of warp threads would cause bunching in the curved portion of the cable 2. Any such bunched threads in the curved portion could also become entangled with other electronic components or cause other problems during installation of the cable.

It is presently contemplated that a variety of twill or herringbone weave patterns can be used in the practice of the present invention. For example, the fill strand 6 could pass over three or more conductors with subsequent displacement of two conductors. In essence, it is presently preferred to use a herringbone pattern, but a straight twill weave is considered satisfactory. It is also presently considered desirable to eliminate warp threads in the cable. A single continuous fill strand is also preferred.

In a preferred embodiment of the invention as illustrated in FIGS. 1 and 2, the conductors 4 are bound together by a single fill strand 6 which is interwoven therewith in a herringbone pattern. As shown more clearly in FIG. 1, the cable 2 includes an outer portion defined by conductors 4*a*–4*h*, an intermediate portion as defined by conductors 4*i*–4*n*, and an inner portion defined by conductors 4*o*–4*t*. As shown, the adjacent rows of parallel lines of the herringbone pattern slope in opposite or reverse directions and meet at an apex as indicated by the letter B in FIG. 2.

The outer portion which is defined by conductors 4*a*–4*h* in the x direction, is also defined by picks 11*b*′–17*a*′ in the y direction. Similarly, the intermediate portion is defined by picks 7*b*′–11*a*′ and 17*b*′–21*a*′ while the full weave or inner portion is defined by picks 1*a*′–7*a*′ and 21*b*′–27*b*′ as illustrated in FIG. 1.

The cable 2 is constructed and arranged, i.e., woven in a manner so that a void area C is formed. The void area C defines a generally V-shaped area with the center and narrowest portion of the void area adjacent to the outer portion of the cable, i.e., the portion where the minimum number of conductors, i.e., 4*a*–4*h*, is bound together by the fill strand 6. This generally V-shaped area may be formed by programming the loom in a manner which will be well understood by those who are skilled in the art. In essence, the fill strand 6 binds a lesser number of conductors, i.e., conductors 4*a*–4*h* in the outer area, 4*a*–4*n* in the intermediate area and 4*a*–4*t* in the inner area to thereby define the V-shaped void or binder free area. As will be readily understood by those who are skilled in the weaving art, the generally V-shaped void area will have adjacent rows sloped in opposite directions in the same configuration as the herringbone weave, as illustrated in FIG. 1.

FIG. 2 illustrates the cable 2 having a curved portion D therein. This curved portion D is formed and then locked in place by heat shrinking the fill strand 6 at a temperature of between 375° and 500° F. The forming of the curves about the V-shaped area may be done by hand with a suitable pattern mandrel or the like. Heat shrinking the fill strand draws the opposite extremities of the V-shaped portion tightly together to thereby form a curved portion in the cable without any apparent void areas or any need for a coating to fix the cable in that form.

In a preferred embodiment of the invention a plurality of gauge wires 8 extend a few inches into the cable 2 which moves in the direction of the arrow during the weaving operation. The gauge wires 8 are relatively small stiff wires which are fixed to the loom adjacent to the conductors 4. The wires 8 remain relatively stationary, i.e., do not move longitudinally with respect to the loom but allow the conductors 4 to move in the y direction in the direction of the arrow. These gauge wires 8 absorb the tension of the fill strand on the edges to reduce the likelihood of the fill strand cutting or nicking the insulation on conductor 4 and for separating the conductors 4 to loosen the weave thus make the shaping or curing process easier.

The woven electrical cables disclosed herein may be produced on a variety of looms. However, the use of a needle loom such as a Muller narrow fabric loom NFn which is manufactured by Jakob Muller A.g., of Frick, Switzerland, is preferred. The operation, use and programming of such looms for forming the void areas as described above are within the capability of those skilled in the art of manufacturing woven cable. For example, the use of a loom and its programming are more fully described in the U.S. Pat. No. 3,835,894, of Speich, entitled "Apparatus for Moving Thread Guide Device of Textile Machines," which is assigned to Jakob Muller and which is incorporated herein in its entirety by reference.

While the invention has been described in connection with a preferred embodiment, it should be understood that numerous changes and modifications may be made therein with out departing from the scope of the appended claims.

What is claimed is:

1. A woven electrical cable having a generally flat construction and a curved portion therein comprising a plurality of conductors and a continuous fill strand interwoven in a twill weave pattern to bind said conductors together, a curved cable portion including outer and inner areas wherein said fill strand is interwoven with a lesser number of conductors in the inner area than in said outer area to thereby form an area which is relatively unbound and free of said fill strand and wherein said fill strand is heat shrunk in said curved portion.

2. A woven electrical cable having a generally flat construction and a curved portion therein according to claim 1 in which said twill weave has a herringbone pattern.

3. A woven electrical cable having a generally flat construction and a curved portion therein according to claim 2 in which said twill weave has a two up two down configuration with the pattern staggered by a single wire.

4. A woven electrical cable having a generally flat construction and a curved portion therein according to claim 2 in which said cable includes a single fill strand and is free of warp binder strands.

5. A woven electrical cable having a generally flat construction and a curved portion therein according to claim 1 which includes an intermediate area wherein said fill strand is interwoven with a lesser number of conductors than said outer area but with a greater number of conductors than said inner area.

6. A woven electrical cable having a generally flat construction and a curved portion therein according to claim 4 which includes an intermediate area wherein said fill strand is interwoven with a lesser number of conductors than said outer area but with a greater number of conductors than said inner area.

7. A method for forming a woven electrical cable of the type having a generally flat construction with a curved portion therein comprising the steps of:

a) providing a plurality of longitudinally extending parallel electrical conductors and a heat shrinkable continuous fill strand;

b) weaving the conductors and the fill strand together in a twill pattern so that the cable has laterally displaced inner and outer portions;

c) forming at least one void area in the woven pattern by weaving together a greater number of conductors in the outer portion than in the inner portion so that the conductors in the void area unbound by the fill strand;

d) forming a curved area which incorporates the void area; and, e) heat shrinking the fill strand in the vicinity of the void area to thereby eliminate the void within the curved portion in the flat cable.

8. A method for forming a woven electrical cable of the type having a generally flat construction with a curved portion therein according to claim 7 wherein the conductors and fill strand are woven in a herringbone pattern.

9. A method for forming a woven electrical cable of the type having a generally flat construction with a curved portion therein according to claim 8 wherein the woven cable is subjected to a temperature of between about 375° and 500° F. to thereby heat shrink the fill strand.

10. A method for forming a woven electrical cable of the type having a generally flat construction with a curved portion therein according to claim 9 wherein the entire cable is subjected to the heat treatment for a period of about 10 seconds.

11. A method for forming a woven electrical cable of the type having a generally flat construction with a curved portion therein according to claim 8 wherein an intermediate portion is formed in the cable with a greater number of conductors bound by the fill strand than in the inner portion but with a lesser number of conductors bound together than in the outer portion to thereby form a generally V-shaped void area in the cable prior to forming and heat shrinking.

12. A method for forming a woven electrical cable of the type having a generally flat construction with a curved portion therein according to claim 7 which includes the step of separating the conductors during the weaving thereof by inserting a plurality of gauge wires between the conductors and thereby provide a looser weave.

* * * * *